US007802690B2

(12) United States Patent
Lohrman et al.

(10) Patent No.: US 7,802,690 B2
(45) Date of Patent: Sep. 28, 2010

(54) CLOSURE HAVING EXPANDED PERIPHERAL SURFACE

(75) Inventors: Richard D. Lohrman, North Aurora, IL (US); Mike Xiaoli Ma, San Jose, CA (US)

(73) Assignee: Portola Packaging, Inc., Batavia, IL (US)

( * ) Notice: Subject to any disclaimer, the term of this patent is extended or adjusted under 35 U.S.C. 154(b) by 693 days.

(21) Appl. No.: 11/259,177

(22) Filed: Oct. 24, 2005

(65) Prior Publication Data

US 2007/0090080 A1 Apr. 26, 2007

(51) Int. Cl.
*B65D 41/00* (2006.01)

(52) U.S. Cl. ..... 215/305; 215/252; 215/258; 215/344; 220/276

(58) Field of Classification Search ..... 215/252, 215/258, 305, 344; 220/276
See application file for complete search history.

(56) References Cited

U.S. PATENT DOCUMENTS 3,286,866 A * 11/1966 McIntosh ..... 215/329
5,207,783 A * 5/1993 Burton ..... 215/256
D369,748 S 5/1996 Zemlo et al.
D370,631 S 6/1996 Zemlo et al.
D371,074 S 6/1996 Zemlo et al.
5,578,491 A * 11/1996 Kayal et al. ..... 435/288.1
5,853,097 A 12/1998 Ekkert
D405,695 S 2/1999 Zemlo
D408,284 S 4/1999 Ekkert et al.
D409,491 S 5/1999 Ullrich et al.
5,950,849 A 9/1999 Ekkert et al.
5,967,351 A 10/1999 Ekkert
6,783,014 B2 8/2004 Luker
2004/0238478 A1* 12/2004 Druitt et al. ..... 215/344
2007/0144999 A1* 6/2007 King ..... 215/330

* cited by examiner

*Primary Examiner*—Anthony Stashick
*Assistant Examiner*—Elizabeth Volz
(74) *Attorney, Agent, or Firm*—James P. Hanrath; Adam K. Sacharoff

(57) ABSTRACT

A closure includes a ribbed design wherein the ribs improve the ability to manually manipulate the closure and produce a distinctive aesthetic appearance. The new design allows improved manufacturing ability while reducing closure cost.

10 Claims, 5 Drawing Sheets

CLOSURE HAVING EXPANDED PERIPHERAL SURFACE

BACKGROUND OF THE INVENTION

1. Field of the Invention

This invention relates, in general, to closures and more particularly to closures having an expanded peripheral surface, and methods for their use and manufacture.

2. Description of Related Art

The past number of years has seen a substantial growth in distinctive food packaging designs intended to promote brand identity, product distinction and consumer convenience. One market segment of particular emphasis is that of relatively small "single service" packages of consumable fluids such as dairy and juice products. The nature of these products justifies the "value added" appeal of such distinctive packaging.

Often the unique "single service" packaging involves design features on both a container and closure. Regarding closures, it is often advantageous to have a relatively large, expanded outside diameter region for ease of gripping and/or aesthetic appearance combined with a smaller diameter cylindrical skirt on which a container engagement structure such as threads is disposed. The smaller diameter skirt is intended to mate with a container neck of diameter suitable for ease of pouring or drinking while the expanded outside diameter improves manual handling of the closure.

One way to achieve a desired relationship between outside diameter and inside diameter would be to form a solid cylinder closed at one end. However, in many cases the thickness of the cylindrical shape would be excessive, leading to impractical processing requirements and excessive material consumption. Thus, one approach to achieving an expanded outside "gripping" diameter for a closure is the design of a "double shell" arrangement for the closure, such as that embodied in U.S. Pat. No. 6,783,014 to Luker. In this "double shell" arrangement, an inside skirt and an outside skirt both depend from a common, typically disk-like top. The inside skirt normally includes container engaging structure while the outside skirt offers improved handling characteristics. An annular space separates inside and outside skirts.

Another arrangement to achieve an expended outside gripping surface combined with a reduced diameter neck engaging structure is shown in U.S. Pat. Nos. 5,853,097 and 5,967,351 to Ekkert, and in U.S. Pat. Nos. 5,950,849 and Des. 408,284 to Ekkert et al. In the Ekkert patents there is shown a closure design having a top wall in the form of a circular disk defining an outermost diameter. A skirt having a diameter less than the outermost diameter of the top wall depends from the top wall. The depending skirt includes threads positioned on its cylindrical inner wall to mate with complimentary container threads. A plurality of arcuately shaped parallel ribs extends from the bottom surface of the top wall to the exterior surface of the depending skirt. The combination of the top wall diameter extension and the parallel ribs forms an enlarged grasping area for manual handling of the closure.

A number of issues arise when reviewing the overall features of the closures embodied in the above-mentioned Ekkert patents. First, to facilitate application of the closure to the container, the tamper evident band is shown and taught to be spaced outwardly from the closure skirt. This arrangement, when combined with the extending solid top surface, creates a circumferential pocket wherein the mold steel forming the ribs is disposed during manufacture. Thus, this arrangement requires the mold to incorporate components commonly referred to as "slides", which remove the rib forming metal in a direction essentially perpendicular to the closure axis. This of course complicates molding and cost. Moreover, this arrangement forces the ribs to be disposed in aesthetically restricted parallel positioning. Finally, the arrangement is accompanied by detailed tapering of the ribbing as is described in the above-mentioned Ekkert '097 patent.

A second issue associated with the closures embodied in the Ekkert patents is the interference type mechanism of the tamper evident band. This type of band has proven to be somewhat unreliable when the closure is used in conjunction with containers produced by relatively imprecise manufacturing such as extrusion blow molding.

A third issue associated with the embodiments of the Ekkert patents is the integral joining of the ribs to both the underside of the top wall extension and the outer surface of the inner depending skirt. This structural situation is essentially present in many prior art disclosures. Further examples are taught in U.S. Design Pat. Nos. 369,748, 370,631, 371,074 to Zemlo et al., U.S. Design Pat. No. 405,695 to Zemlo, and U.S. Design Pat. No. 409,491 to Ullrich et al. These patents all show ribs extending between and joined to both the top surface and inner skirt of the closure. This structural arrangement causes the skirt to be relatively rigid and unyielding. The result is that the threads may need to be formed by a rotating tool component which essentially unscrews to remove the component from the closure during part ejection from the mold. This significantly increases the complexity of the mold compared to ejection using straight axial movement only. In addition, this objectionable aspect is normally accompanied by an increase in material consumption for the part.

It is noted that some embodiments of the Ekkert disclosure identified above involve removal of the top wall extension such that the ribs are freestanding. Specifically, the embodiments of FIG. 9 of the Ekkert '849 patent and FIGS. 11 and 12 of the Ekkert '097 patent show no extension of the top surface radially outward of the closure skirt dimension. In these cases, the mold and manufacturing complexities defined above could be alleviated. However, these suggestions bring about other problems. First, the large open exposed regions between ribs are aesthetically objectionable. Second, in order for the unsupported ribs to function properly they would likely have to be thickened to prevent bending and distortion during application and consumer handling. Finally, a significant amount of valuable label area on the top surface of the closure is lost using these embodiments.

There is thus a continuing need for improved closures having an expanded diameter gripping surface along with a reduced diameter container engagement structure from the perspectives of aesthetics, material consumption, performance and manufacturability.

BRIEF SUMMARY OF THE INVENTION

In summary, one aspect of the present invention is directed to a closure including a top having an outside circumference defining a peripheral edge, the top further having an upper top surface and a lower top surface, a skirt depending from the lower top surface, the skirt having an outer skirt surface and an inner skirt surface, the outer skirt surface positioned inwardly of the peripheral edge, the spacing between an intersection of the outer skirt surface with the lower top surface and the peripheral edge defining an annular portion of the lower top surface, and multiple structures depending downwardly from the annular portion of the lower top surface, the structures having inner edges. The inner edges are separated from the outer skirt surface.

The closure may include a tamper evidencing band. The tamper evidencing band may be connected to the skirt through a frangible line of weakness. In one embodiment, an exterior surface of the tamper evidencing band does not extend radially outside the circumferential surface defined by the exterior surface of the skirt.

The skirt may be dimensioned and configured to freely expand during ejection from a mold. The closure may include container engagement structure on the inner skirt surface. The container engagement structure may be dimensioned and configured for snap-on application to and screw-off removal from a container neck finish. The closure may include a connecting member that extends between two or more of the multiple structures. The connecting member may be spaced from the exterior surface of the skirt. The connecting member may include a back wall connecting the inner edges of the two or more structures.

Another aspect of the present invention is directed to a closure including a top including a peripheral edge and an underside, a skirt depending from the underside, the skirt including an outer skirt surface positioned radially inwardly of the peripheral edge, in which the underside of the top includes an annular portion extending between the peripheral edge and the outer skirt surface, and a structure depending downwardly from the annular portion, the structure having an inner free edge. The inner free edge may be spaced from and unconnected to the outer skirt surface.

The skirt may be dimensioned and configured to freely expand during ejection from a mold. In one embodiment, the structure does not extend outwardly from the peripheral edge.

The structure may include a radially extending vertical rib downwardly depending from the underside. The closure may include a plurality of structures depending downwardly from the underside, each having an inner free edge spaced from and unconnected from the outer skirt. The plurality of structures may include a plurality of radially extending vertical ribs downwardly depending from the underside. A connecting member may extend between two or more of the plurality of structures. The connecting member may be spaced from the exterior surface of the skirt. The connecting member may be a back wall connecting the inner free edges of two or more of the plurality of structures.

The closure having expanded peripheral surface of the present invention has other features and advantages which will be apparent from or are set forth in more detail in the accompanying drawings, which are incorporated in and form a part of this specification, and the following Detailed Description of the Invention, which together serve to explain the principles of the present invention.

DETAILED DESCRIPTION OF THE INVENTION

Figure 1:
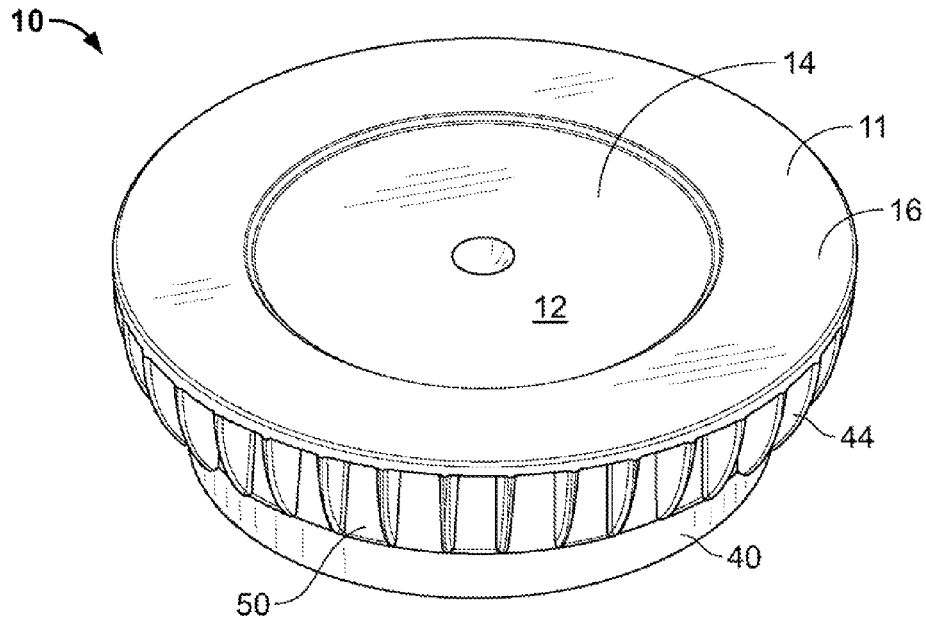
FIG. 1 is an isometric view from above showing one embodiment of the closure of the present invention.
Figure 2:
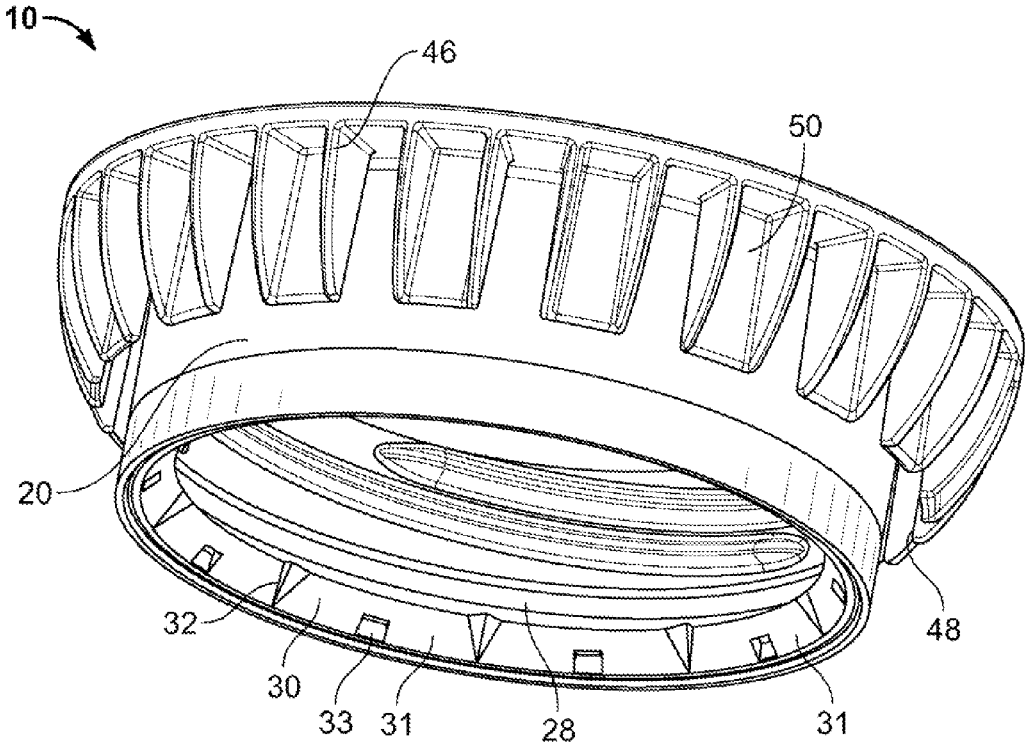
FIG. 2 is an isometric view form below showing the closure embodied in FIG. 1.
Figure 3:
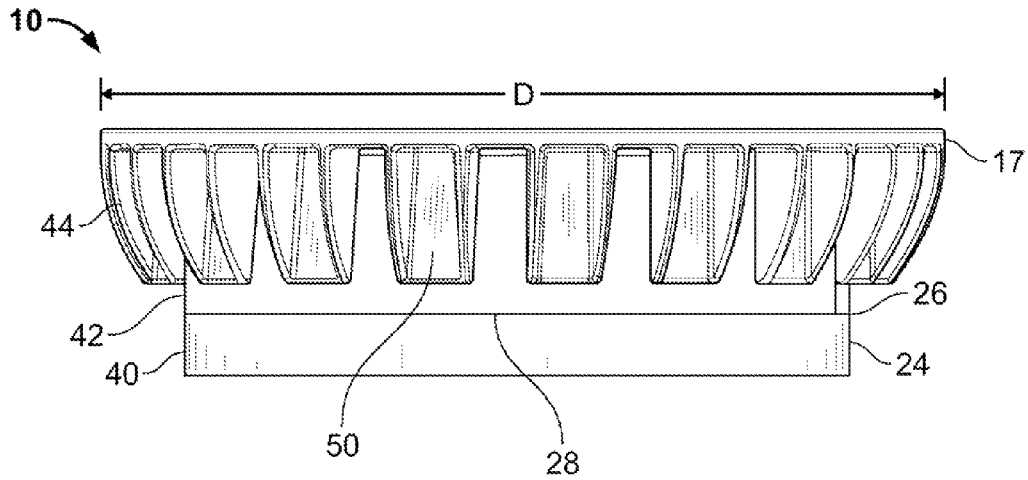
FIG. 3 is a side view of the closure embodied in FIGS. 1 and 2.
Figure 4:
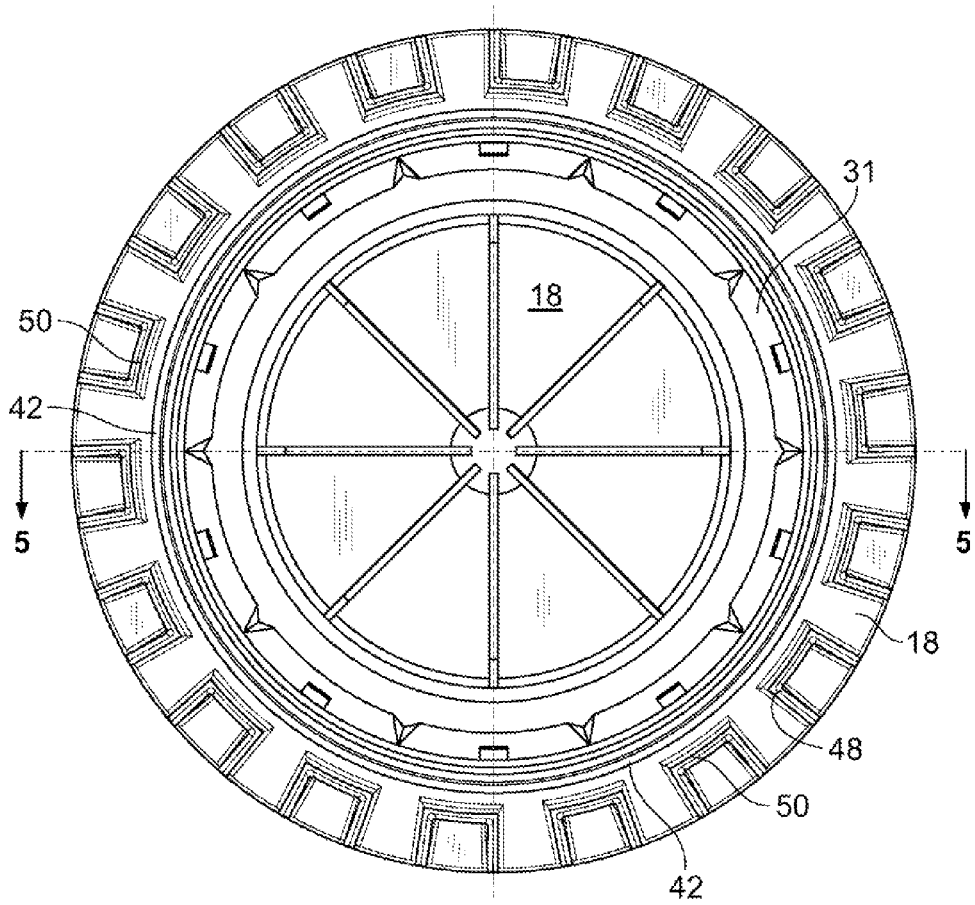
FIG. 4 is a bottom plan view of the closure embodied in FIGS. 1-3.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Referring now to FIGS. 1-5, there is shown a closure 10 in isometric views from top and bottom respectively. Closure 10 has a top 11 having upper surface 12. In the illustrated embodiment, top 11 includes a generally flat inner disk 14. Joined to the outer periphery of disk 14 is a radially extending annular ring 16. In the embodiment, inner disk 14 is slightly depressed relative to annular ring 16. It is understood that in other embodiments of upper surface 12 can take other forms such as totally flat, convex inward or outward etc. Closure 10 has a maximum outside diameter "D" defined by the diameter of the peripheral edge 17 of annular ring 16. Top 11 also has bottom surface 18.

Figure 5:
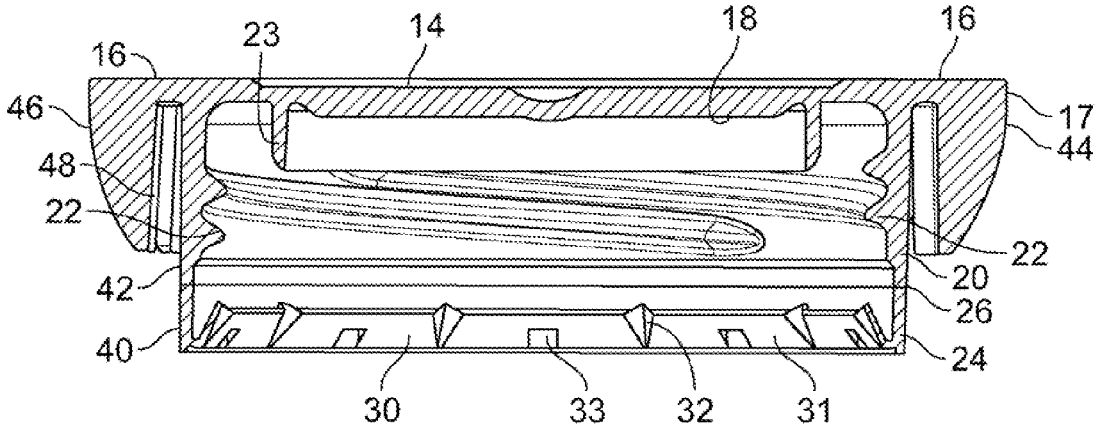
FIG. 5 is a sectional view taken substantially along line 5-5 of FIG. 4.

Closure 10 also includes skirt 20 depending from bottom surface 18 as best seen in FIG. 5. Skirt 20 is of diameter less than diameter "D" and is positioned radially inwardly of the peripheral edge 17 of annular ring 16. Container engagement structure is positioned on the inner surface of skirt 20. In the embodiment shown, the container engaging structure is in the form of threads 22. As is known, mating threads are used to secure the closure to a container by relative rotation of the components, or in some systems by a "snapping" or axial application of the closure to the container finish. Alternatively, it is understood that other forms of container engaging structure such as snap beads, lugs, etc. may be chosen for alternate embodiments, in which case a "snap-on/pull-off" mechanism may be used.

Depending from the base of skirt 20 is tamper evidencing band 24. Tamper evidencing band 24 is connected to the base of skirt 20 through a frangible line of weakness 26. In the embodiment of FIGS. 1-5, frangible line 26 is created by having the band integrally joined to skirt 20 only through multiple, circumferentially spaced bridges 28. Such a frangible line can be formed during molding of the closure 10 or by a post-molding slitting operation as is known in the art. Alternate structure for the frangible line of weakness, such as a circumferential tear line, may be chosen where appropriate.

Band 24 includes band retaining portion 30. Retaining portion 30 comprises multiple upwardly-inwardly extending segments 31 joined by radially outwardly directed flutes 32. Segments 31 include drain holes 33 in the embodiment of FIG. 1-5. During initial application of the closure to a container, the flutes open to allow circumferential expansion of the band retaining portion 30, thereby permitting facile passage over exterior container threads and finally an outwardly directed retention bead positioned on the exterior surface of a container finish. The band retaining portion 30 subsequently settles beneath the container retention bead, thereby preventing initial removal of the closure without rupturing the bridges 28. The structure embodied in band 24 has proven to be an extremely reliable tamper evidencing means. However, other cooperating container/tamper band retention structure may be appropriate in other embodiments.

It is to be noted that the exterior surface 40 of band 24 does not extend radially outside of the circumferential surface defined by the exterior or outer surface 42 of skirt 20. This is an important feature of this embodiment of the invention allowing for simplification of the molding apparatus as will be shown.

The embodiment shown in FIGS. 1-5 further includes multiple rib-like structures 44 depending from the bottom surface 18 of top 11. In the embodiment, an outside edge 46 of the ribs 44 extends in an arcuate path from a point proximal the peripheral edge 17 of annular ring 16 to an innermost edge 48 of ribs 44. The innermost edges 48 of ribs 44 are not connected to the exterior surface 42 of skirt 20. This is an important aspect of the invention in that it allows the beneficial aspects of the rib-like structures while still allowing the closure skirt to freely expand. This permits the closure to be ejected from the mold by simple axial movement to strip the threads 22 (or other interior structure disposed on the interior of the closure skirt). In addition, allowing unimpeded elastic expansion of the closure skirt 20 often promotes facile application to a container neck, as in the case of a snap-on closure. While the embodiment of FIGS. 1-5 shows the ribs having an arcuate outer edge and an essentially straight inner edge, it will be appreciated that other geometries may be chosen, such as triangular, elliptical, spherical, etc. Indeed, the invention contemplates any number of structural forms could be chosen to depend from bottom surface 18 of top 11 in the annular portion of bottom surface 18 between the intersection of the exterior skirt surface 42 with the lower top surface 18 and the peripheral edge 17. The only consideration is that the structural forms be positioned relative to the exterior skirt surface so as not to impede the elastic expansion of the skirt during processing or application to a mating container.

Figure 6:
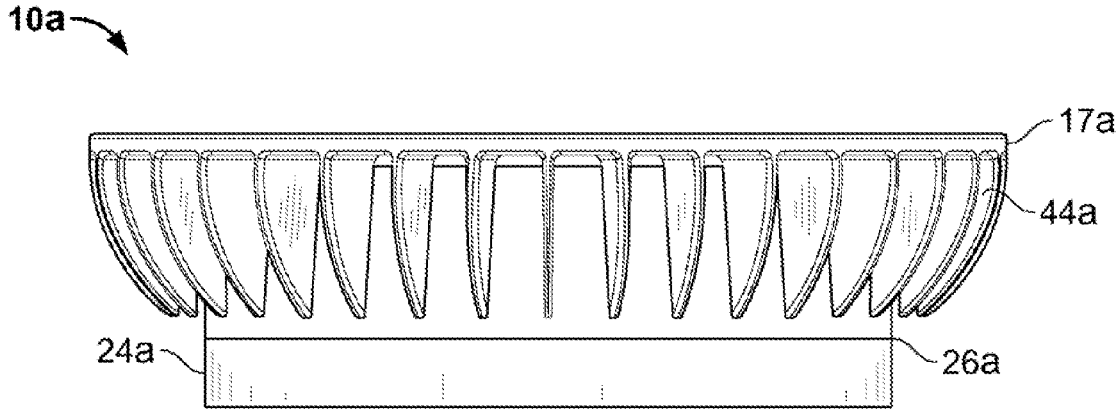
FIG. 6 is a side elevational view showing an alternate embodiment of a closure according to the current invention.

The structural forms depending from the bottom surface 18 of top 11 may be further enhanced by additional members connecting multiple forms. For example, in the embodiment of FIGS. 1-5, a back wall 50 extends between the inside edges 48 of circumferentially positioned pairs of ribs. This back wall structure increases the ability of the ribs to resist deformation and helps prevent entanglement of the ribs during bulk handling. These back walls 50 are also spaced from the exterior surface 42 of skirt 20 as best seen in the bottom plan view of FIG. 4. It is noted that while in the embodiment of FIGS. 1-5, a back wall is shown connecting or joining pairs of ribs, more than two ribs may be connected to a common back wall. Indeed, the back wall could extend 360 degrees to join all the ribs to a common back wall. Alternatively, selected ribs may remain free standing absent a back wall connection. Indeed, the back wall connection among adjacent ribs may be completely eliminated in other embodiments such as that depicted in FIG. 6. It is noted that in the FIG. 6 closure embodiment features similar to those of the embodiment of FIGS. 1-5 are designated by the same numeral followed by the letter "a".

Figure 7B:
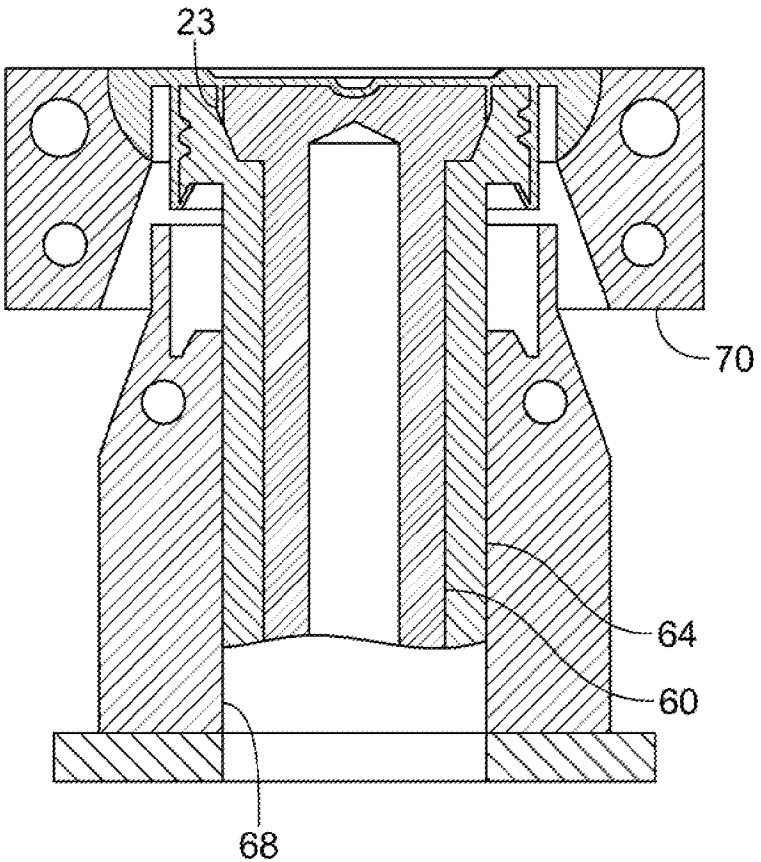
FIGS. 7A, 7B, 7C and 7D are a series of drawings showing the mold movements during the molding of the closure of FIGS. 1-5.
Figure 7A:
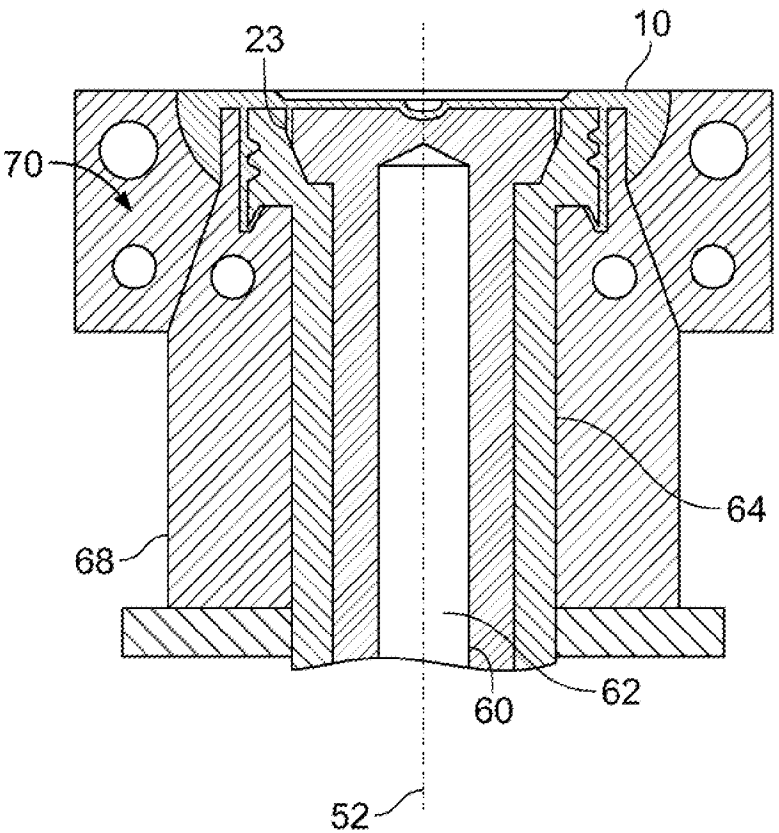

Referring now to FIGS. 7A-7D there is shown a portion of a plastics injection molding tool capable of producing the closure embodied in FIGS. 1-5. In FIG. 7A, there is depicted the situation following injection of plastic to form closure 10 and separation of the "stationary half" of the mold as is known in the art ("Stage 1"). Push pin 60 is positioned with its axis 52 collinear with the axis of closure 10. Push pin 60 is generally cylindrical at a first end and flares out as shown at its top portion which forms a portion of the bottom surface 18 of top 11 of closure 10. Push pin 60 also includes cooling channel 62. Surrounding push pin 60 is inner core 64. Inner core 64 has a surface which forms a portion of the underside of closure 10, the inner surface of skirt 20 including its internal threads, and the inner surface of band 24. Inner core 64 also mates with push pin 60 to form sealing plug 23 as shown. Surrounding inner core 64 is outer core 68. Outer core 68 provides the mold surface to form the outer surface of skirt 20, the outer surface of band 24, the inner surface of back walls 50 and a small annular portion of the bottom surface 18 of top 11 of closure 10. An additional mold component, stripper ring 70 provides the mold surface forming the exterior surfaces of rib-like structures 44 and back walls 50. Stripper ring 70 also provides the surface forming a portion of the underside of closure 10 extending to peripheral edge 17.

Figure 7D:
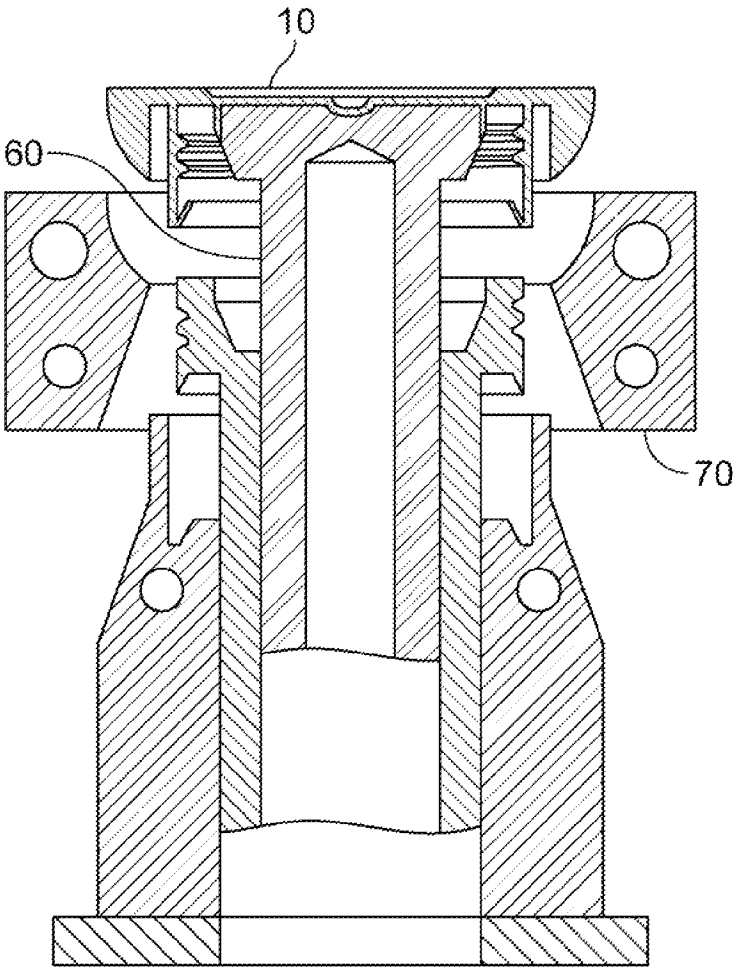
Figure 7C:
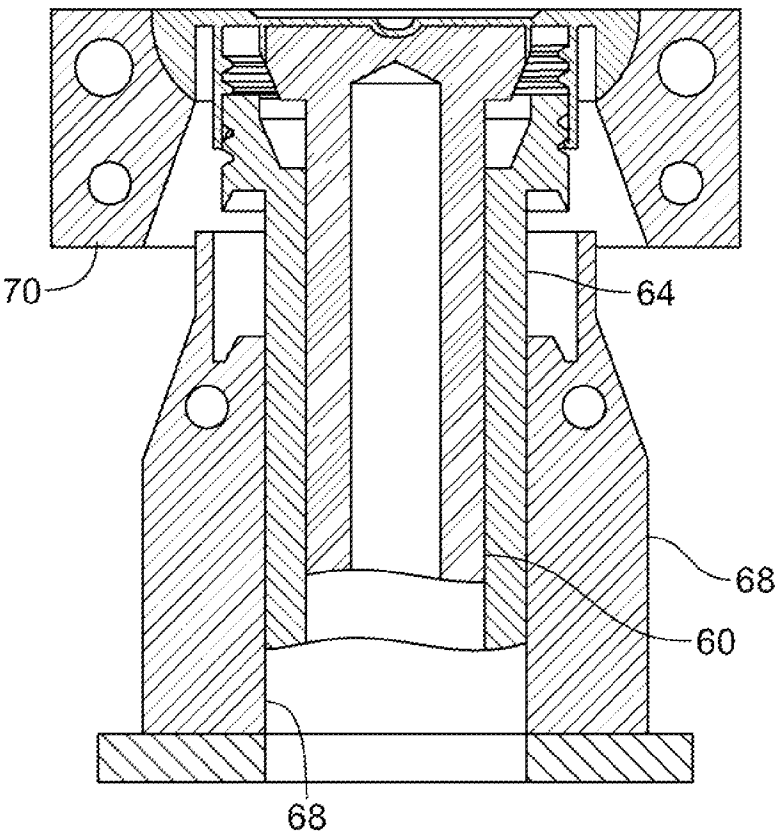

Referring now to Stages 2-4 depicted in FIG. 7B-7D respectively, there is shown a sequence of movements of the mold components defined above to accomplish removal of closure 10 from the mold. In Stage 2, push pin 60, inner core 64, and stripper ring 70 have moved axially away from outer core 68 to expose the exterior surfaces of skirt 20, band 24, and a portion of bottom surface 18. In Stage 3, the stripper ring 70 and push pin 60 move axially relative to the inner core 64 to remove the inner surface of the closure skirt. This action involves elastic expansion of the skirt as the container engagement means (e.g., the threads 22 in the embodiment of FIGS. 1-5) located on the inner surface of the closure skirt slip over the corresponding structure of the inner core 60. It is noted that this "stripping" action associated with removal of the container engagement means from the mold is possible because the inner edges 48 of ribs 44 and back walls 50 are spaced from and unconnected to the outer or exterior surface 42 of skirt 20. Such an "unconnected" configuration allows skirt 20 to freely flex radially outwardly thus facilitating de-molding, namely because such flexing allows the engagement means to disengage from the corresponding structure of the inner core. In Stage 4 the stripper ring stops and the push pin 60 continues its forward axial movement to complete ejection of closure 10 from the mold.

Advantageously, the present invention provides an improved closure design incorporating ribs disposed to facilitate expansion of gripping surface. Also, the present invention provides a unique closure system which further incorporates improved tamper evidencing.

Additionally, the present invention intends to improve manufacturability of closures and allow production of closures at reduced manufacturing and material cost.

For convenience in explanation and accurate definition in the appended claims, the terms "up" or "upper", "down" or "lower", "inside" and "outside" are used to describe features of the present invention with reference to the positions of such features as displayed in the figures.

In many respects the modifications of the various figures resemble those of preceding modifications and the same reference numerals followed by subscripts "a" designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A closure comprising:

a top having an outside circumference defining a peripheral edge, said top further having an upper top surface and a lower top surface;

a skirt depending from said lower top surface defining in part a first circumferential exterior surface, said skirt having an outer skirt surface and an inner skirt surface, said outer skirt surface positioned inwardly of said peripheral edge, the spacing between an intersection of said outer skirt surface with said lower top surface and said peripheral edge defining an annular portion of said lower top surface;

a plurality of vertical segregated ribs depending downwardly from said annular portion of said lower top surface, said ribs having outside edges extending from points proximal said peripheral edge to inner edges, the inner edges extending upwardly therefrom and to the lower top surface of the top to thereby define exposed exterior surfaces of each rib on opposite sides thereof radially extending between said outside edges and inner edges, said outside edges forming a second circumferential external surface of said closure which is not contiguous and said inner edges being further defined as separated from and non-connecting to said outer skirt surface; and a tamper evidencing band connected to said skirt through a frangible line of weakness.

2. The closure of claim 1 wherein an exterior surface of said tamper evidencing band does not extend radially outside the circumferential exterior surface defined by said skirt.

3. The closure of claim 1 wherein said skirt is dimensioned and configured to freely expand during ejection from a mold.

4. The closure of claim 1 wherein a connecting member extends between two or more of said ribs, said connecting member being spaced from said circumferential exterior surface defined by said skirt.

5. The closure of claim 4 wherein said connecting member comprises a back wall connecting the inner edges of said two or more ribs.

6. A closure comprising:

a top including a peripheral edge and an underside;

a skirt depending from the underside defining in part a circumferential exterior surface, the skirt including an outer skirt surface positioned radially inwardly of the peripheral edge;

the underside of the top including an annular portion extending between the peripheral edge and the outer skirt surface;

a plurality of radially extending vertical ribs depending downwardly from the annular portion having exposed exterior surfaces on opposite sides thereof, the ribs having an inner free edge depending downwardly from the underside of the top and being radially inwardly of the peripheral edge and spaced from and unconnected to the outer skirt surface; and a connecting member extending between two or more of said ribs, said connecting member being spaced from said circumferential exterior surface defined by said skirt.

7. The closure of claim 6 wherein said skirt is dimensioned and configured to freely expand during ejection from a mold.

8. The closure of claim 6 wherein the rib does not extend outwardly from the peripheral edge.

9. The closure of claim 6 wherein the connecting member is a back wall connecting the inner free edges of two or more of the plurality of ribs.

10. A closure comprising:

a top including a peripheral edge and an underside;

a single skirt depending from the underside defining in part a circumferential exterior surface, said skirt having an outer skirt surface and an inner skirt surface, said outer skirt surface positioned radially inwardly of the peripheral edge;

the underside of the top including an annular portion extending between the peripheral edge and the outer skirt surface;

a rib depending downwardly from the annular portion, the rib having an inner free edge depending downwardly from the underside of the top and being radially inwardly of the peripheral edge;

wherein the inner free edge is spaced from and unconnected to the outer skirt surface; and container engagement structure on said inner skirt surface, said container engagement structure being dimensioned and configured for snap-on application to, and screw-off removal from a container neck finish.

* * * * *